US007878947B1

(12) United States Patent
Rodgers, Jr.

(10) Patent No.: US 7,878,947 B1
(45) **Date of Patent: *Feb. 1, 2011**

(54) CRANK SYSTEM ASSEMBLIES AND METHODS FOR USE THEREOF

(76) Inventor: Robert E. Rodgers, Jr., 974 Kings Point Dr., Canyon Lake, TX (US) 78133

( * ) Notice: Subject to any disclaimer, the term of this patent is extended or adjusted under 35 U.S.C. 154(b) by 234 days.

This patent is subject to a terminal disclaimer.

(21) Appl. No.: 12/116,867

(22) Filed: May 7, 2008

Related U.S. Application Data

(60) Provisional application No. 60/928,619, filed on May 10, 2007, provisional application No. 61/072,564, filed on Apr. 1, 2008.

(51) Int. Cl.
*A63B 22/04* (2006.01)
*A63B 22/06* (2006.01)

(52) U.S. Cl. ..... 482/52; 482/51; 482/57

(58) Field of Classification Search ..... 428/51–53, 428/57–65, 70, 79–80
See application file for complete search history.

(56) References Cited

U.S. PATENT DOCUMENTS

| | | | | | |
|---|---|---|---|---|---|
| 1,166,304 | A | | 12/1915 | Albert | |
| 4,940,233 | A | | 7/1990 | Bull et al. | |
| 5,611,756 | A | * | 3/1997 | Miller | 482/52 |
| 5,735,773 | A | * | 4/1998 | Vittone et al. | 482/52 |
| 5,795,268 | A | * | 8/1998 | Husted | 482/51 |
| 5,910,072 | A | | 6/1999 | Rawls et al. | |
| 5,967,944 | A | | 10/1999 | Vittone et al. | |
| 5,989,163 | A | | 11/1999 | Rodgers, Jr. | |
| 6,004,244 | A | | 12/1999 | Simonson | |
| 6,036,622 | A | * | 3/2000 | Gordon | 482/51 |
| 6,045,487 | A | * | 4/2000 | Miller | 482/52 |
| 6,113,518 | A | * | 9/2000 | Maresh et al. | 482/52 |
| 6,152,859 | A | * | 11/2000 | Stearns | 482/52 |
| 6,579,210 | B1 | | 6/2003 | Stearns et al. | |
| 6,626,802 | B1 | * | 9/2003 | Rodgers, Jr. | 482/51 |
| 6,689,019 | B2 | * | 2/2004 | Ohrt et al. | 482/52 |
| 6,761,665 | B2 | * | 7/2004 | Nguyen | 482/51 |
| 6,926,646 | B1 | * | 8/2005 | Nguyen | 482/71 |
| 7,112,161 | B2 | * | 9/2006 | Maresh | 482/52 |
| 7,507,184 | B2 | * | 3/2009 | Rodgers, Jr. | 482/52 |
| 2005/0049117 | A1 | | 3/2005 | Rodgers, Jr. | |
| 2005/0124466 | A1 | | 6/2005 | Rodgers, Jr. | |
| 2005/0124467 | A1 | | 6/2005 | Rodgers, Jr. | |
| 2006/0217234 | A1 | | 9/2006 | Rodgers, Jr. | |
| 2007/0219061 | A1 | | 9/2007 | Rodgers, Jr. | |
| 2007/0219062 | A1 | | 9/2007 | Rodgers | |

OTHER PUBLICATIONS

U.S. Appl. No. 60/780,599, filed Mar. 9, 2006, Rodgers, Jr.
U.S. Appl. No. 60/881,205, filed Jan. 19, 2007, Rodgers, Jr.

* cited by examiner

*Primary Examiner*—Steve R Crow
(74) *Attorney, Agent, or Firm*—Fulbright & Jaworski L.L.P.

(57) ABSTRACT

An exercise apparatus comprises: a frame; a crank system supported by the frame; a right and left foot members supported by the frame; first and second flexible element coupled to the crank system and foot support members such that downward motion of either foot support member causes rotation of the crank system; and a crank offset assembly configured to prevent the crank system from becoming locked at a top dead center location.

39 Claims, 11 Drawing Sheets

CRANK SYSTEM ASSEMBLIES AND METHODS FOR USE THEREOF

CROSS-REFERENCE TO RELATED APPLICATIONS

This application claims priority to U.S. Provisional Patent Application 60/928,619, filed May 10, 2007 and entitled "LINKAGE AND CRANK SYSTEMS" and to U.S. Provisional Patent Application 61/072,564 filed Apr. 1, 2008 and entitled "LINKAGE AND CRANK SYSTEMS", the disclosures of which are hereby incorporated herein by reference.

TECHNICAL FIELD

The present description relates generally to crank systems for exercise devices and, more particularly, it relates to crank system assemblies for flexible element exercise devices.

BRIEF SUMMARY OF THE INVENTION

Various embodiments of the invention relate to crank systems offset assemblies that prevent crank lockup in flexible element exercise devices. In one example, a spring is coupled to a journal in a crank system to provide a displacing force.

In another example, guide elements are positioned asymmetrically.

In another example, guide elements can be repositioned.

In another example, a linkage system is coupled to the crank system. The linkage system comprises guide elements for the flexible elements. Interaction of the crank system and linkage system causes displacement of the guide elements.

In another example, the crank system has asymmetric geometry.

An exercise device according to the present invention may be used to create offset between flexible element tension vectors and a crank system axis. Such offset can prevent lock up of the crank system.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

In the following detailed description, reference is made to the accompanying drawings, in which are shown by way of illustration specific embodiments of the present invention. It should be understood that the detailed description and specific examples are intended for purposes of illustration only and are not intended to limit the scope of the invention. Numerous changes, substitutions, and modifications may be made without departing from the scope of the present invention.

Exercise devices that utilize flexible elements are described in U.S. Patent Application Publication Nos. US 2006/0217234 A1 by Rodgers, Jr., US 2007/0219061 A1 by Rodgers, Jr., and US 2007/0219062 A1 by Rodgers, Jr., each of which is incorporated by reference as if fully set forth herein. These referenced applications describe flexible element exercise devices that utilize flexible elements coupled to crank systems and foot support members. Users of these flexible element exercise devices may cause rotation of the crank systems by undertaking stepping or striding motions. The right side foot support member may be coupled through a first flexible element to a first crank arm, and the left foot support member may be coupled through a second flexible element to a second crank arm. If a crank system with similar sized and shaped crank arms is utilized in a flexible element exercise device, crank lock up may occur in certain circumstances. For example, if the user ascends the flexible element exercise device and puts most of his/her weight on the right foot support member for a short time, the first flexible element will pull the first crank arm to a bottom dead center location. In a traditional crank system design, this situation places the opposing second crank arm at a top dead center location.

When the user transfers weight to the left foot support member to initiate exercise, the second flexible element will apply force to the second crank arm which is at a top dead center location. The crank system will be locked and unable to rotate. In the above referenced applications, a counterweight is utilized to prevent the crank system from settling into a top dead center location.

Figure 1A:
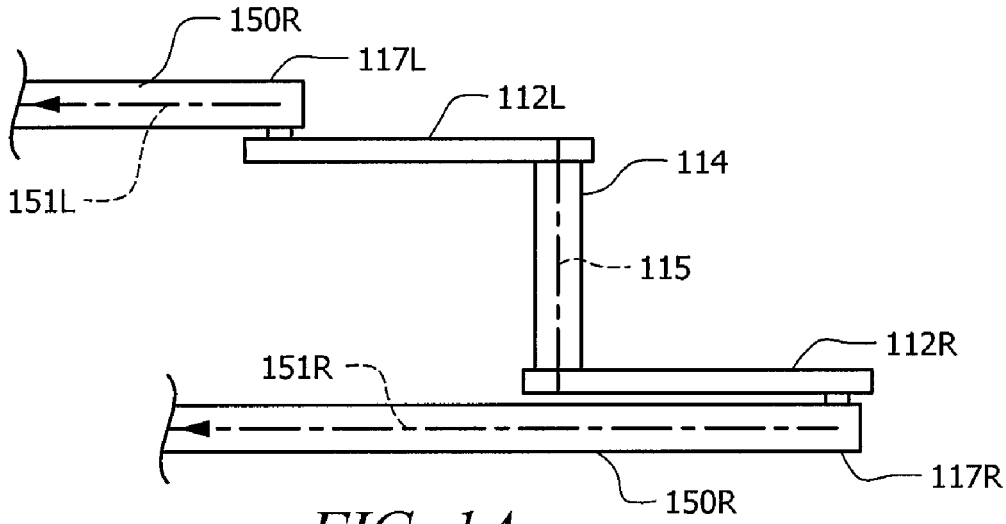
FIG. 1 depicts a top and side view of a simple crank system.
Figure 1B:
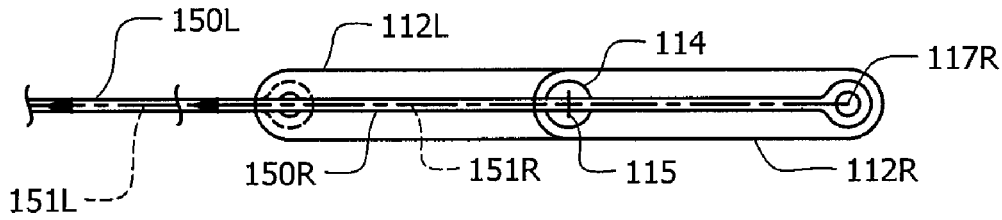

FIG. 1 shows a top view and a side view of an example of a simple crank system with flexible elements. Right and left crank arms 112R and 112L are coupled to crank shaft 114. As used herein, the term "coupling" or "coupled" includes a direct coupling or an indirect coupling. The crank system has a crank system axis 115 which is the effective axis about which the crank system rotates. The crank shaft 114 would typically be supported by rotational bearings which are not shown. Right and left flexible elements 150R and 150L are coupled to right and left crank arms 112R and 112L at crank system coupling locations 117R and 117L. Crank arms 112R and 112L have mirror symmetry when viewed from the side, i.e. down the crank system axis, and crank system coupling locations 117R and 117L are located at 180 degrees relative to each other with the crank axis serving as the origin of measurement.

The simple crank system of FIG. 1 is widely used, but a crank system may be of other configurations yet have similar or identical function. A crank system will typically have an axis of rotation and coupling locations away from the axis so that force applied at the coupling locations creates torque and rotary motion about the axis. As an example, a crank system could have multiple arms. Alternately, a crank system could be a disc with a central shaft and with coupling locations near the periphery which effectively act as crank arms. Alternately, a crank system could be a ring supported by rollers; the ring could have coupling locations near the periphery which effectively act as crank arms. Alternately, certain planetary gear systems may function as a crank system having a crank system axis and coupling locations near the periphery.

If in FIG. 1 continuous tension is applied to flexible element 150 L, crank arm 112L will align with the applied tension vector, which is represented by the center line and arrow 151 L. For the purposes of this application, a tension vector is a line that defines the direction of tension in a flexible element. The tension vector may project beyond the flexible element as it is defining direction. The tension vector will generally pass through the flexible element, but its exact location relative to the cross section of the flexible element is typically affected by the type and construction method of the flexible element. The tension vector is shown in the center of flexible element 150L, and for purposes of this discussion the tension vector is analyzed for that portion of the flexible element near the crank system.

In one example, the application of continuous tension occurs when a user pauses while using a flexible element exercise device. During such a pause, the user may apply the majority of his/her weight to one foot support member which in turn applies greater tension to the flexible element coupled to that foot support member. The foot plate on the foot support member will then go to its lowest resting position. In this simple crank system, during such a pause with the foot plate at its lowest resting position, tension vector 151L will intersect crank system axis 115 (shown as a line running through crankshaft 114 lengthwise—it is also the axis of rotation of the crank system). The intersection of crank axis 115 and tension vector 151L creates a bottom dead center condition for crank arm 112L and a top dead center condition for crank arm 112R.

The terms "top" in "top dead center" and "bottom" in "bottom dead center" do not necessarily describe the physical location in space of the crank arms, but rather the geometric positioning of the crank arms and coupling locations in relation to the flexible elements, crank system axis, and tension vectors. Depending on the structure of the flexible element exercise device, a crank arm that may be in a "bottom dead center" location may be physically located above or level with the opposing crank arm. Further, a crank arm that may be in a "top dead center" location may be physically located below or level with the opposing crank arm. For the purposes of this discussion, a crank system is in a "dead center position" when at least one of the tension vectors intersects the crank system axis.

Following a pause in exercise on a flexible element exercise device, the user will transfer weight from one foot support member to the other in order to initiate rotation of the crank system. However, the simple crank system shown in FIG. 1 has settled into a top dead center/bottom dead center position during the pause. Transfer of weight by the user now tensions flexible element 150R. Tension vector 151R intersects crank system axis 115. Because there is no offset between tension vector 151R and crank system axis 115, there is no crank system torque generated by flexible element 150R, and the crank system is in a locked condition.

Figure 2:
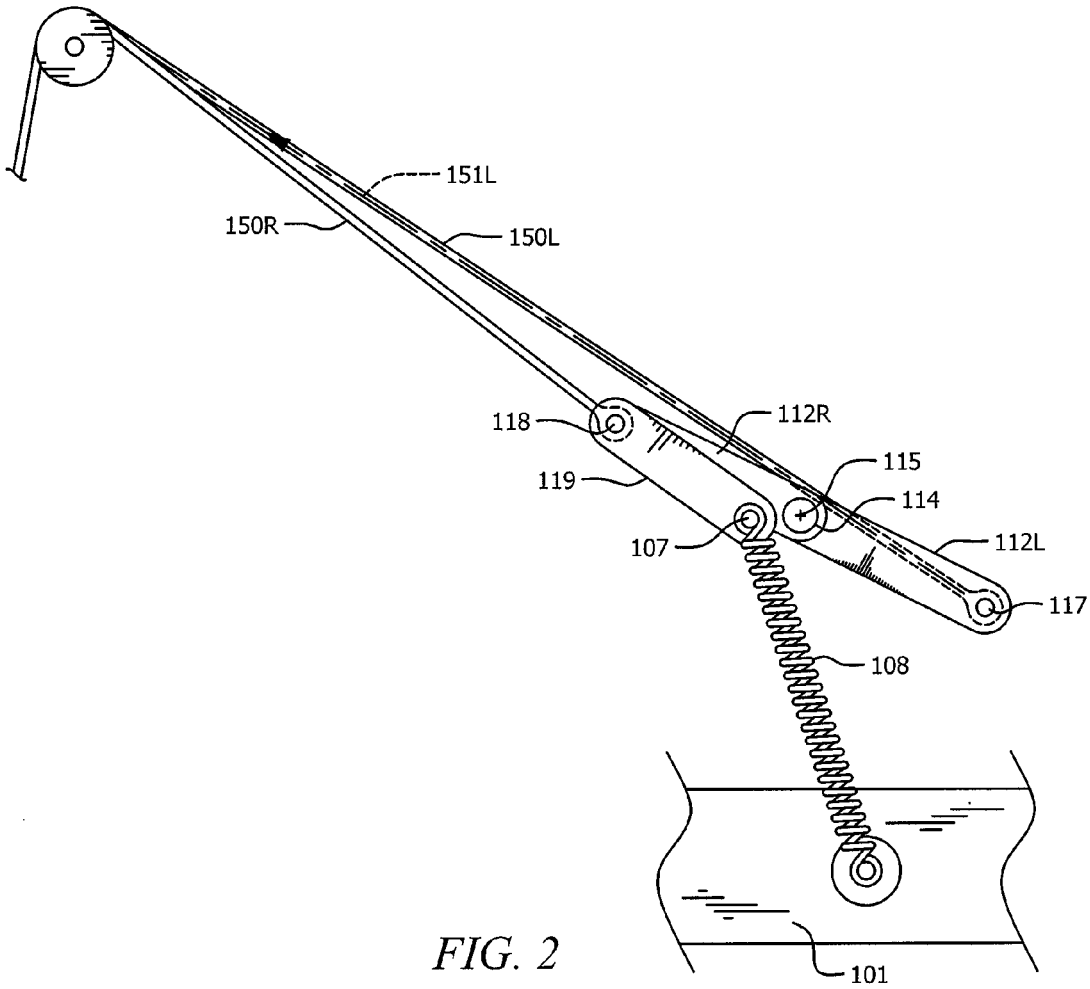
FIG. 2 depicts a side view of an example embodiment of a crank system adapted according to an embodiment of the present invention.
Figure 2A:
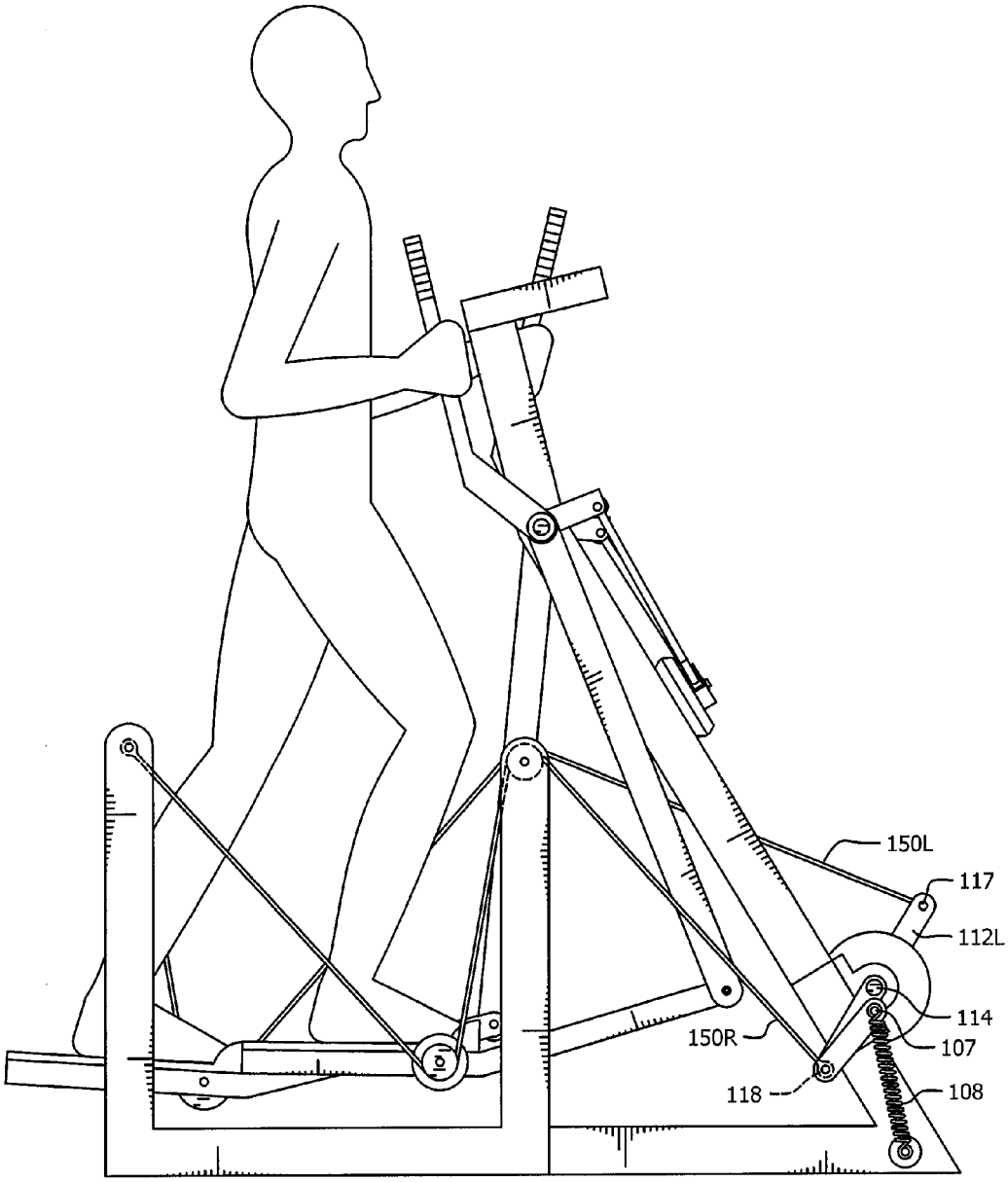
FIG. 2A depicts a side view of an example flexible element exercise device incorporating the embodiment of FIG. 2.

FIG. 2 shows a side view of an example embodiment of a crank system for a flexible element exercise device. FIG. 2A shows how the embodiment of FIG. 2 can be implemented in an example flexible element exercise device. Operational aspects of the FIG. 2A type of exercise device are described in (US 2007/0219061 A1). The embodiment of FIG. 2 can be implemented in other configurations of flexible element exercise devices, and its use is not restricted only to the flexible element exercise device shown in FIG. 2A. Crank arm 112R is coupled to crank shaft 114. Crank shaft 114 has an axis 115 that is also the crank system axis. Secondary crank arm 119 is rigidly coupled to crank arm 112R at journal 118. Crank arm 112L is coupled to crank shaft 114. Spring 108 is coupled to frame 101 and to secondary crank arm 117 at coupling location 107. Coupling location 107 is selected so that it is offset from crank axis 115. Flexible element 150R is coupled to crank arm 112R at journal 118. Flexible element 150L is coupled to crank arm 112 L. During a pause in exercise on the flexible element exercise device with one foot plate at its lowest resting position, the majority of force has been applied to one foot support member that has in turn tensioned flexible element 150R. Spring 108 applies a force to secondary crank arm 119 and generates an offset torque in the crank system. The amount and location of the offset between coupling location 107 and crank axis 115 and the orientation and characteristics of spring 108 are specified by the designer of the machine so to achieve the desired offset torque when the crank system is at or near a dead center position. This torque displaces the crank system slightly during the pause and causes crank system offset between the tension vector 151 L and crank system axis 115. Crank system lockup created by a top dead center condition is prevented.

Figure 3:
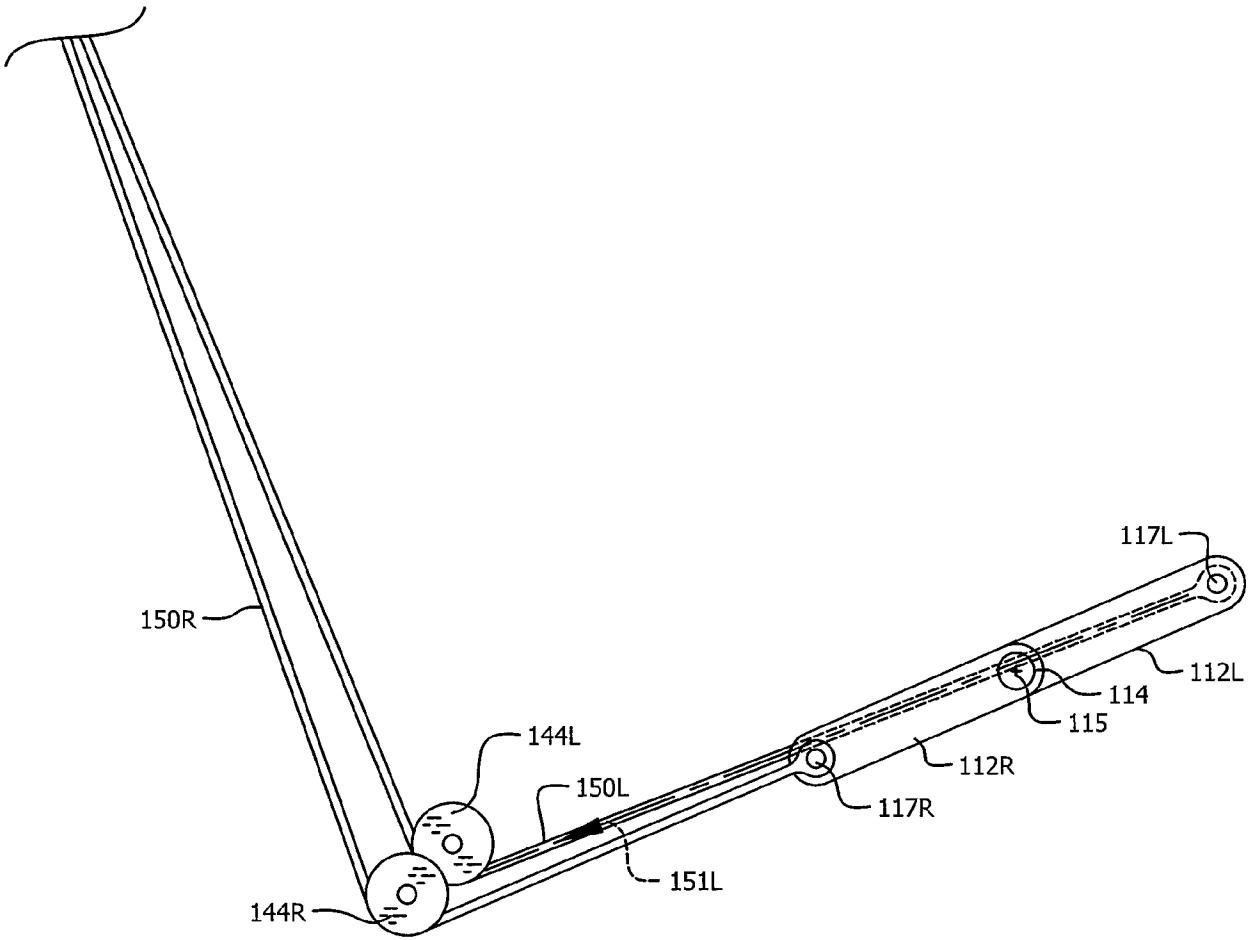
FIG. 3 depicts a side view of an example embodiment of a crank system adapted according to an embodiment of the present invention.
Figure 3A:
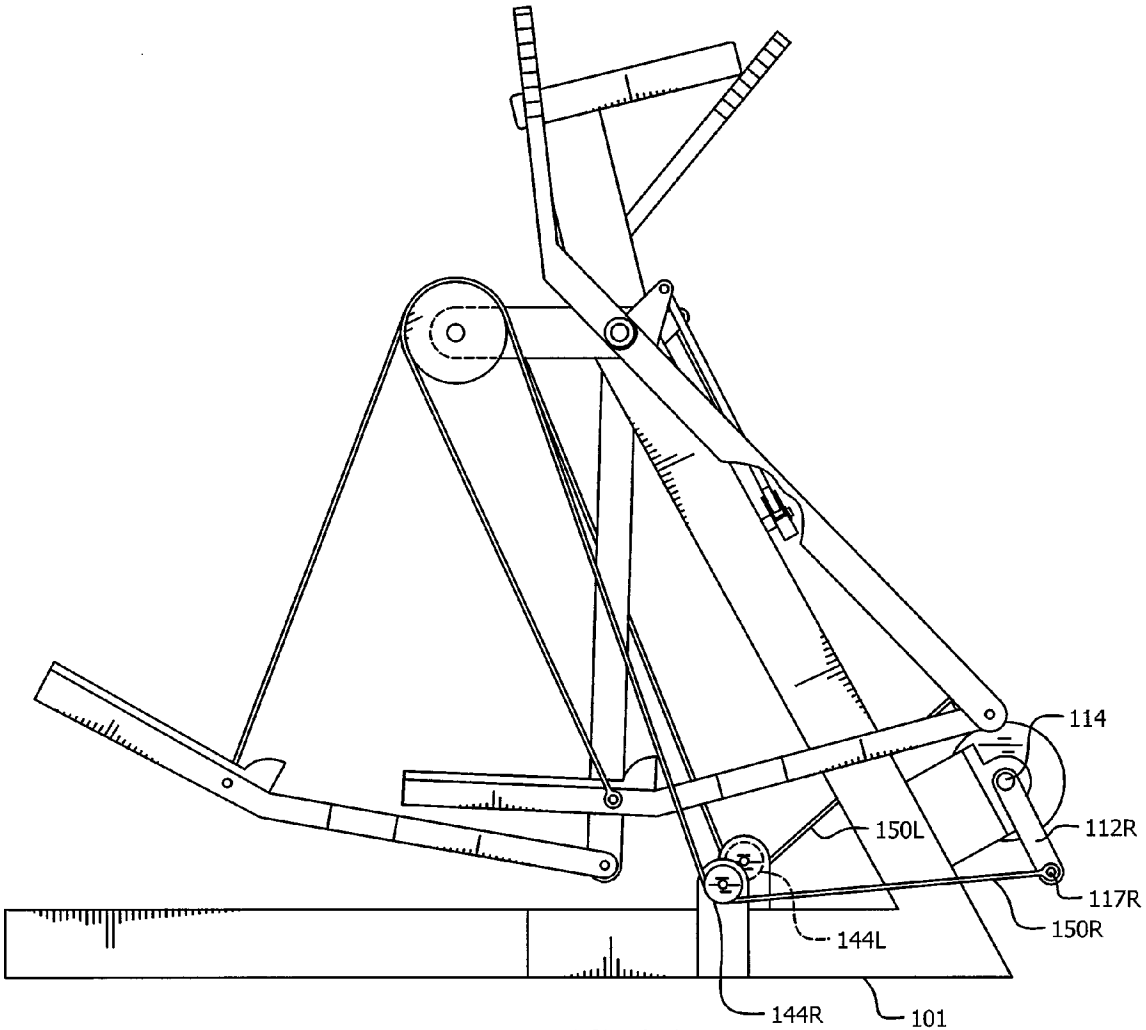
FIG. 3A depicts a side view of an example flexible element exercise device incorporating the embodiment of FIG. 3.

FIG. 3 shows a side view of an example embodiment of a crank system for a flexible element exercise device. FIG. 3A shows how the embodiment of FIG. 3 can be implemented in an example flexible element exercise device. Operational aspects of the FIG. 3A type of exercise device are described in (US 2006/0217234 A1). The embodiment of FIG. 3 can be implemented in other configurations of flexible element exercise devices, and its use is not restricted only to the flexible element exercise device shown in FIG. 3A. Crank arms 112R and 112L are coupled to crank shaft 114. Flexible element 150R is coupled to crank arm 112R at coupling location 117R. Flexible element 150L is coupled to crank arm 112L at coupling location 117L.

Many exercise devices are generally symmetric between the right and left sides, i.e. the left side is a mirror image of the right side. However, the embodiment of FIG. 3 has asymmetric guide elements 144R and 144L. Guide element 144R is coupled to frame 101 and guides flexible element 150R. Guide element 144L is coupled to frame 101 and guides flexible element 150L. Guide element 144L is coupled to frame 101 at a location that is different than the mirrored location of guide element 144R so that there is asymmetry in the locations of 144R and 144L. In other words, if a vertical plane is drawn along the machine center line when viewed from above and between guide elements 144L and 144R, the asymmetry of this example exists with respect to the plane. In various examples, asymmetry includes one guide element being higher vertically than the other and/or one guide element being closer to the front of the device than the other. The asymmetry is apparent when viewing the embodiment of FIG. 3 from the side.

During a pause in exercise on the flexible element exercise device with one foot plate at its lowest resting position, the majority of force has been applied to one foot support member that has in turn tensioned flexible element 150R. Flexible element 150R has pulled crank arm 112R to a bottom dead center location in relation to crank axis 115. As the user initiates exercise, weight is transferred to the opposing foot support member, and greater tension is created in flexible element 150L. The asymmetric geometry of guide elements 144R and 144L causes crank system offset so that tension vector 151L does not intersect crank system axis 115 at the moment of weight transfer. Thus, the tension in flexible element 150L causes an offsetting torque that moves crank arms 112R and 112L, even though crank arm 112R is in a bottom dead center position. Similarly, when crank arm 112L rotates to a bottom dead center position, the asymmetry of guide elements 144R and 144L ensures that offsetting torque will allow the crank system to rotate. Crank system lockup created by a dead center condition is prevented.

Figure 4:
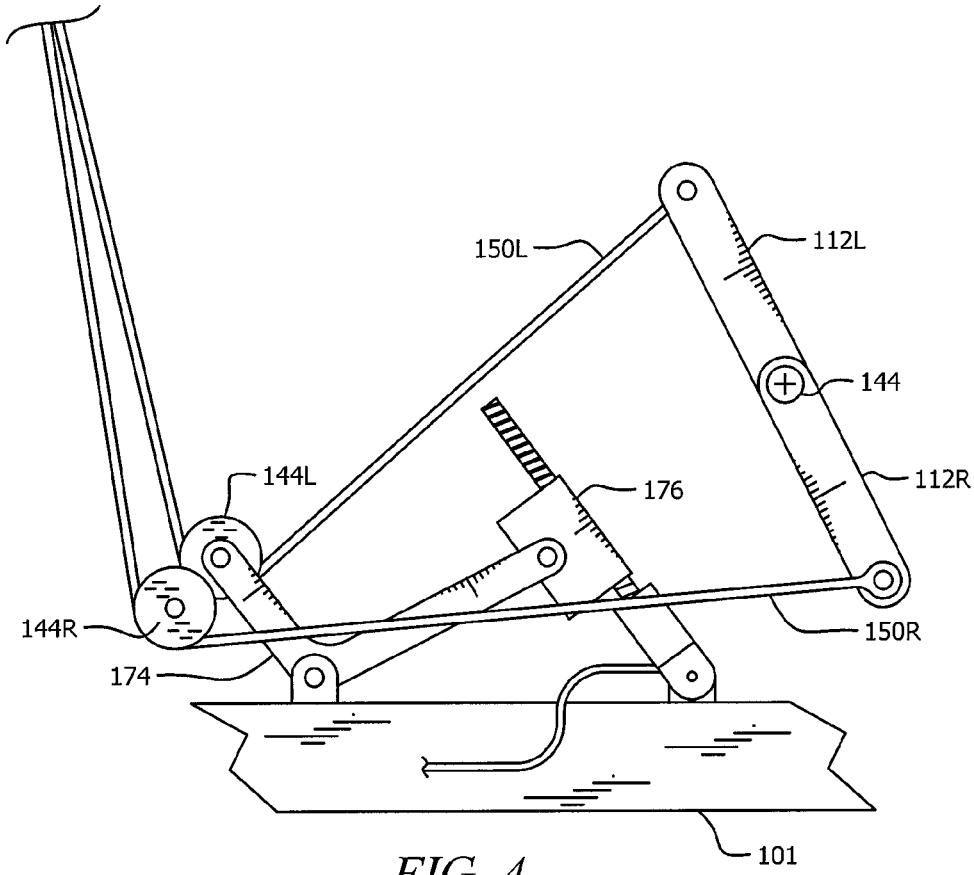
FIG. 4 depicts a side view of an example embodiment of a crank system adapted according to an embodiment of the present invention.
Figure 4A:
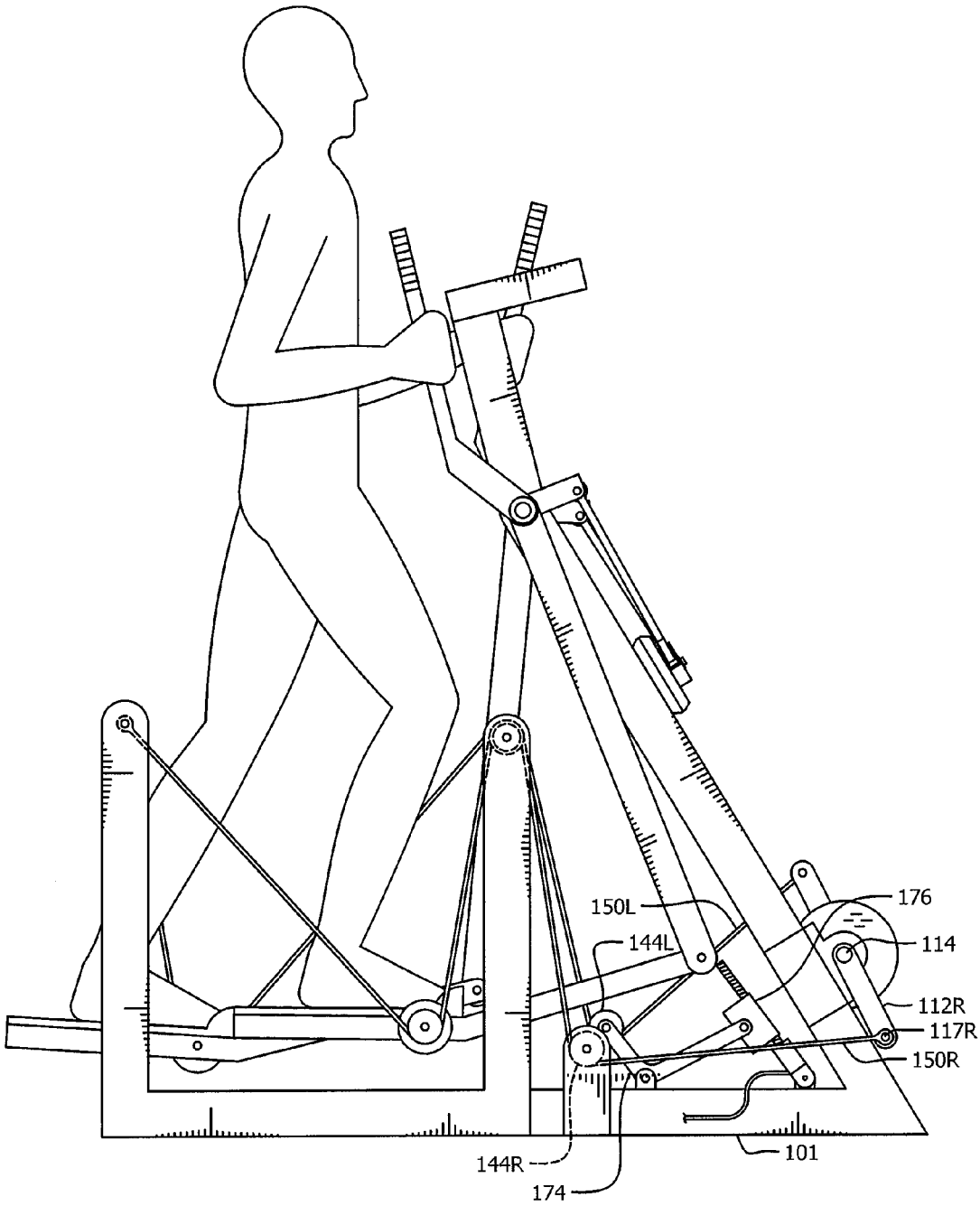
FIG. 4A depicts a side view of an example flexible element exercise device incorporating the embodiment of FIG. 4.

FIG. 4 shows a side view of an example embodiment of a crank system for a flexible element exercise device. FIG. 4A shows how the embodiment of FIG. 4 can be implemented in an example flexible element exercise device. Operational aspects of the FIG. 4A type of exercise device are described in US 2007/0219061 A1. The embodiment of FIG. 4 can be implemented in other configurations of flexible element exercise devices, and its use is not restricted only to the flexible element exercise device shown in FIG. 4A. The operation of the embodiment of FIG. 4 is similar to that of FIG. 3 in that the asymmetric geometry of guide elements 144R and 144L causes crank system offset. However, the embodiment of FIG. 4 provides for adjustment of the position of at least one of the guide elements. Guide element 144L is attached to rocker mount 174. Rocker mount 174 is pivotally coupled to frame 101, and its position can be adjusted by servo/screw assembly 176. Therefore, actuation of servo/screw assembly 176 changes the position of guide element 144L. During a pause in exercise, guide element 144L can be moved so as to create asymmetric geometry in relation to 144R. After crank rotation is initiated, guide element 144L can be moved to create symmetric geometry in relation to 144L. Other embodiments include, additionally or alternatively, a mechanism for adjusting guide element 144R. Repositioning of one or both guide elements can be done in a variety of automatic or manual methods as those skilled in the art will understand.

Figure 5:
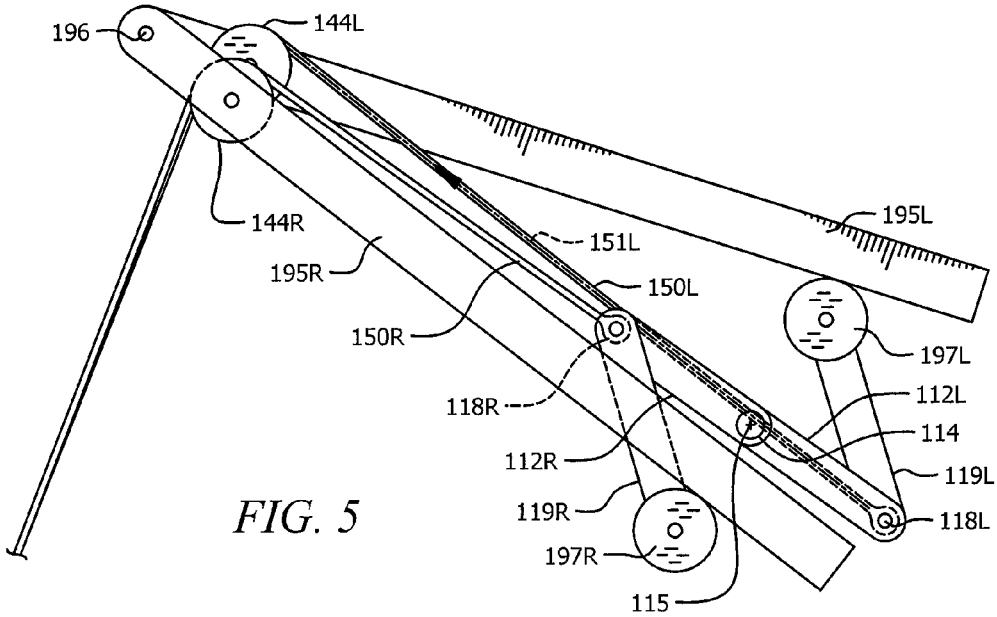
FIG. 5 depicts a side view of an example embodiment of a crank system adapted according to an embodiment of the present invention.
Figure 5A:
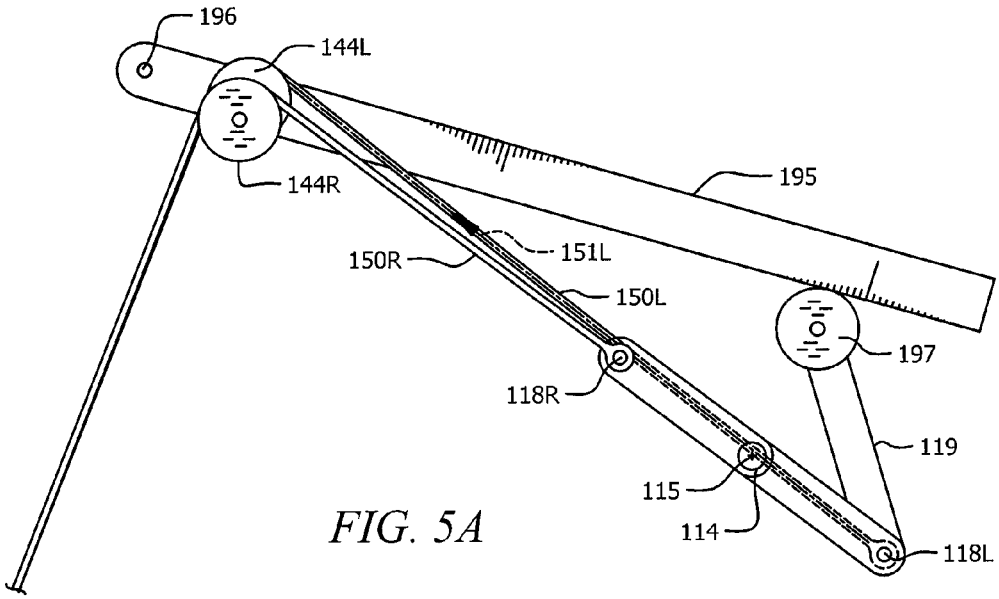
FIG. 5A depicts a side view of an example embodiment of a crank system adapted according to an embodiment of the present invention.
Figure 5B:
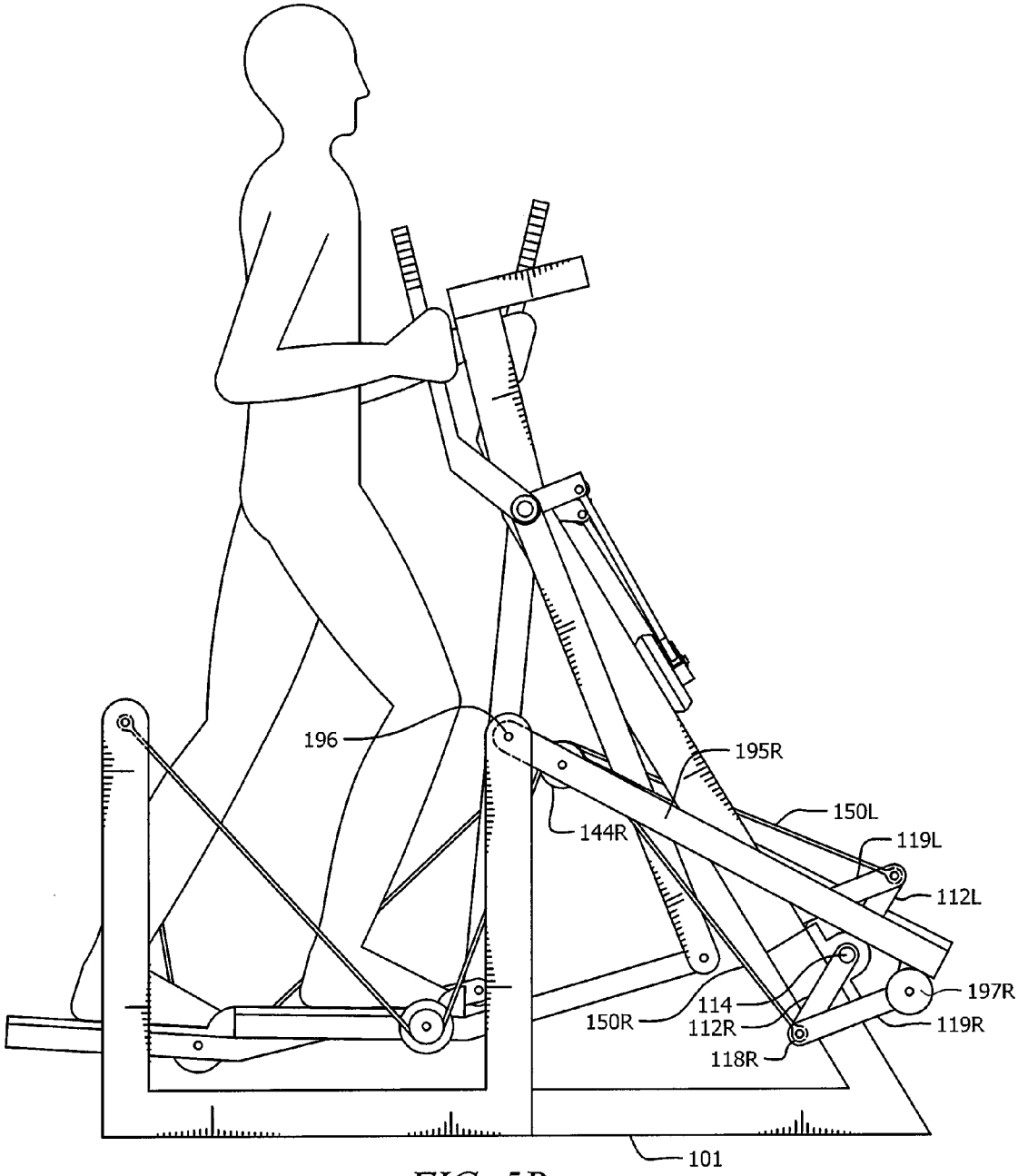
FIG. 5B depicts a side view of an example flexible element exercise device incorporating the embodiment of FIG. 5.

FIG. 5 shows a side view of an embodiment of an example crank system for a flexible element exercise device. FIG. 5B shows how the embodiment of FIG. 5 can be implemented in an example flexible element exercise device. Operational aspects of the FIG. 5B type of exercise device are described in US 2007/0219061 A1. The embodiment of FIG. 5 can be implemented in other configurations of flexible element exercise devices, and its use is not restricted only to the flexible element exercise device shown in FIG. 5B. The embodiment of FIG. 5 has asymmetric guide element geometry, as in FIG. 3, and the guide elements move with crank system rotation. Crank arm 112R is coupled to crank shaft 114. Secondary crank arm 119R is rigidly coupled to crank arm 112R at journal 118R. Crank arm 112L is coupled to crank shaft 114. Secondary crank arm 119L is rigidly coupled to crank arm 112L at journal 118L. Flexible element 150R is coupled to crank arm 112R at journal 118R. Flexible element 150L is coupled to crank arm 112L at journal 118L Flexible element 150R engages guide element 144R, and flexible element 150L engages guide element 144L. Guide element 144R is coupled to and supported by support link 195R. Support link 195R is pivotally coupled near one end to frame 101 at location 196. The other end of support link 195R is coupled to the crank system by the engagement of support link 195R with Roller 197R, which is attached to secondary crank arm 119R. Guide element 144L is attached to and supported by support link 195L. Support link 195L is pivotally coupled near one end to frame 101 at location 196. The other end of support link 195L is coupled to the crank system by the engagement of support link 195L with roller 197L, which is attached to secondary crank arm 119R. As the crank system rotates, rollers 197R and 197L cause support links 195R and 195L and guide elements 144R and 144L to undergo oscillating motion.

During a pause in exercise on the flexible element exercise device with one foot plate at its lowest resting position, the majority of force has been applied to one foot support member which has in turn tensioned flexible element 150R. Flexible element 150R has pulled crank arm 112R near a bottom dead center location in relation to crank axis 115. In this crank arm position, rollers 197R and 197L have positioned support links 195R and 195L respectively.

As the user initiates exercise, weight is transferred to the opposing foot support member and greater tension is created in flexible element 150L. The position of support link 195L and guide element 144L causes crank system offset so that tension vector 151L does not intersect crank system axis 115 at the moment of weight transfer. The tension in flexible element 144L provides torque that causes crank arms 112R and 112L to rotate. Similarly, when crank arm 112L rotates to a bottom dead center position, the asymmetry of guide elements 144R and 144L ensures that offsetting torque will allow the crank system to rotate. Crank system lockup created by a dead center condition is prevented. The embodiment shown in FIG. 5 has right and left support links with right and left guide elements. However, this embodiment can be configured to operate with only one support link as shown in FIG. 5A. Support link 195 and its associated guide element 144L undergo oscillation as the crank system rotates. Guide element 144 is stationary and supported by the frame 101.

Figure 6:
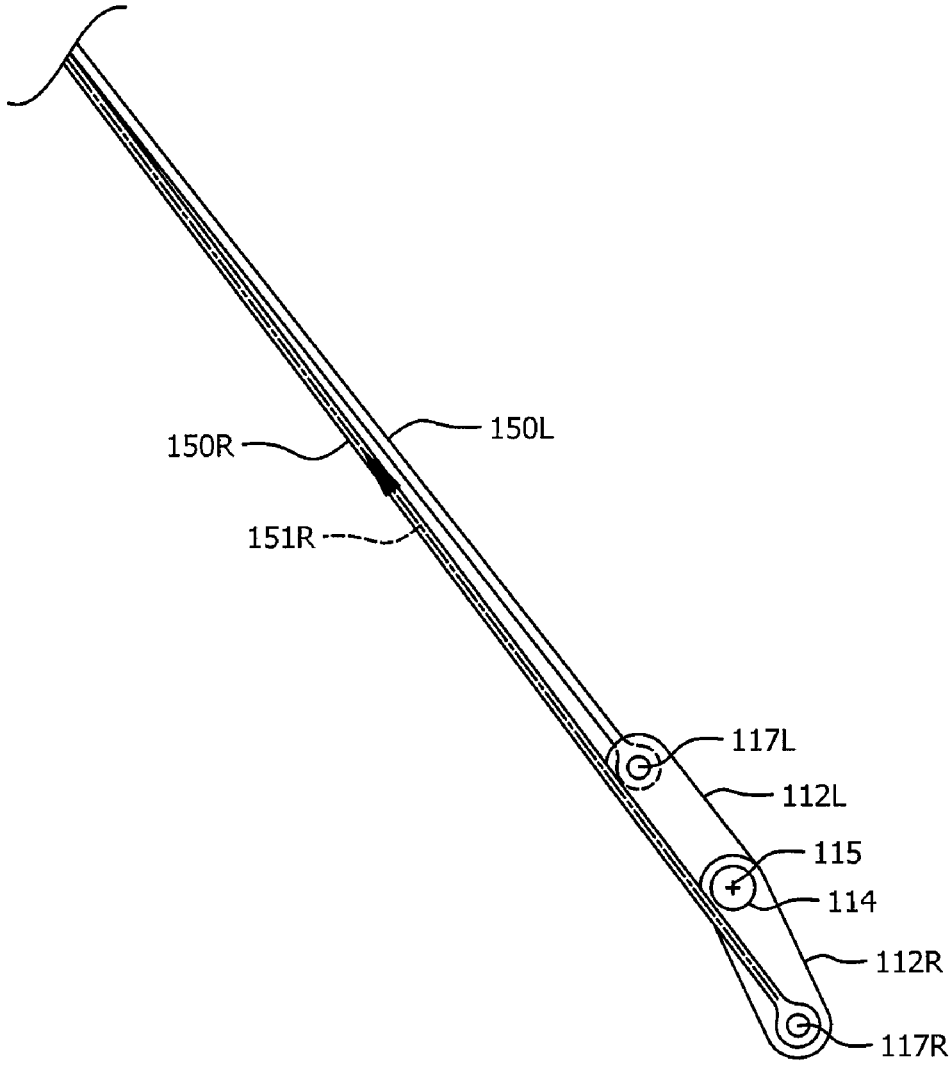
FIG. 6 depicts a side view of an example embodiment of a crank system adapted according to an embodiment of the present invention.
Figure 6A:
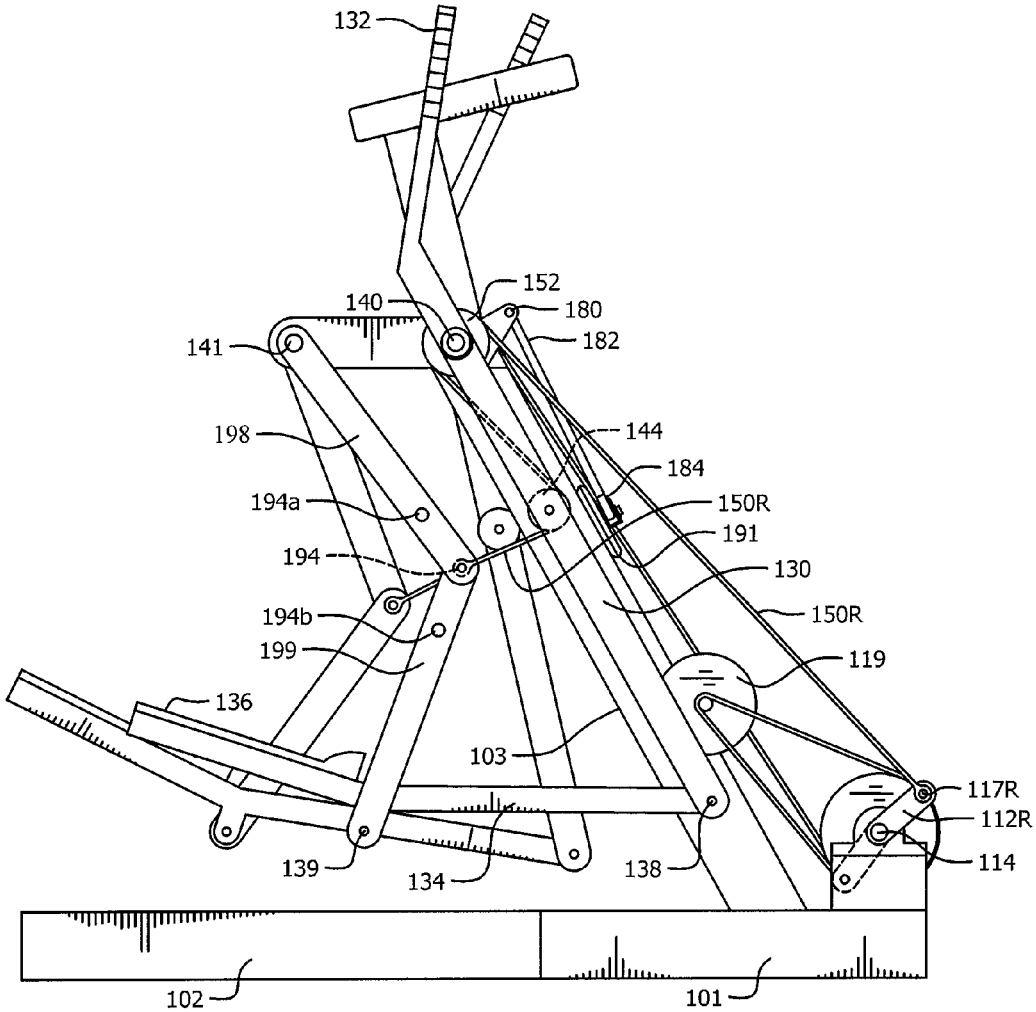
FIG. 6A depicts a side view of an example flexible element exercise device incorporating the embodiment of FIG. 6.

FIG. 6 shows a side view of an embodiment of a crank system for a flexible element exercise device. FIG. 6A shows how the embodiment of FIG. 6 can be implemented in a flexible element exercise device. The embodiment of FIG. 6 can be implemented in other configurations of flexible element exercise devices, and its use is not restricted only to the flexible element exercise device shown in FIG. 6A. Crank arms 112R and 112L are coupled to crank shaft 114. Flexible element 150R is coupled to crank arm 112R at coupling location 117R. Flexible element 150L is coupled to crank arm 112L at coupling location 117L. Typical crank systems with two arms have symmetric mirrored geometry when viewed for the side, i.e. down the crank system axis, where the left crank arm is a mirror of the right crank arm and positioned at 180 degrees relative to the right crank arm with the crank system axis as the origin of angular measurement. The crank arms 112R and 112L and coupling locations 117R and 117L have asymmetric geometry wherein coupling location 117R is not located at a 180 degree position in relation to coupling location 117L.

During a pause in exercise on the flexible element exercise device with one foot plate at its lowest resting position, the majority of force has been applied to one foot support member which has in turn tensioned flexible element 150R. Flexible element 150L has pulled crank arm 112L to a bottom dead center location in relation to crank axis 115. As the user initiates exercise, weight is transferred to the opposing foot support member and greater tension is created in flexible element 150R. The asymmetric geometry of the crank coupling locations causes crank system offset so that tension vector 151R does not intersect crank system axis 115 at the moment of weight transfer. The offset in tension vector 151R causes torque that rotates crank arms 112R and 112L. Similarly, when crank arm 112R rotates to a bottom dead center position, the asymmetry of guide elements 144R and 144L ensures that offsetting torque will allow the crank system to rotate. Crank system lockup created by a top dead center condition is prevented.

FIG. 6A shows a side view of an embodiment of a flexible element exercise device. Frame 101 includes a basic supporting framework including base 102. The lower portion of base 102 engages and is supported by the floor. The crank system includes crank arm 112R attached to crank shaft 114. Only the right side elements in FIG. 6A are numbered, but it is understood that there are opposing left side elements in this embodiment.

The crank system may also include and/or be coupled to a brake/inertia device, such as device 119, coupled to the crank shaft. Alternately, a brake inertia device may be coupled to the crank shaft through a belt and pulley arrangement. Rotation of crank arms 112 about the axis of crank shaft 114 causes rotation of brake/inertia device 119. Brake/inertia device 119 may provide a braking force that provides resistance to the user during exercise, and/or it may provide inertia that smoothes the exercise by receiving, storing, and delivering energy during rotation. Although the embodiment shown in FIG. 6A uses a single brake/inertia device, it is possible to utilize multiple brake/inertia devices or to separate the braking and inertia functions between two or more devices.

A pivotal linkage assembly may include arcuate motion member 130, and foot support member 134, and support members 198 and 199. Although only the elements of the right side pivotal linkage assembly are numbered, it is understood that there is a left side pivotal linkage assembly with comparable elements in this example. In the context of this specification, the term "member" includes a structure or link of various sizes, shapes, and forms. For example, a member may be straight, curved, or a combination of both. A member may be a single component or a combination of components coupled to one another. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138. Foot support member 134 is also coupled to support member 199 at coupling location 139. Coupling of the various members within the pivotal linkage assembly may be accomplished with a pivotal pin connection as shown in FIG. 6A, but coupling may also be accomplished with any device that allows relative rotation between the arcuate motion member 130 and foot support member 134. As used herein, the term "coupling" or "coupled" includes a direct coupling or an indirect coupling. Arcuate motion member 130 is coupled to frame 101 at coupling location 140. Coupling may be accomplished with shaft and bushing as shown in FIG. 6A, but coupling may also be accomplished with any device that allows rotation of arcuate motion member 130 relative to frame 101. Support member 199 is coupled to support member 198 at location 194, and support member 198 is coupled to frame 101 at location 141.

As shown in FIG. 6A, the portion of arcuate motion member 130 coupled to frame 101 is above the portion of arcuate motion member 130 coupled to foot support member 134. In the context of this specification, one element is "above" another element if it is higher than the other element. The term "above" does not require that an element or part of an element be directly over another element. Conversely, in the context of this specification, one element is "below" another element if it is lower than the other element. The term "below" does not require that an element or part of an element be directly under another element.

The flexible support system includes flexible element 150. Flexible element 150 may be a belt, a cog belt, a chain, a cable, or any flexible component able to carry tension. Flexible element 150 may have some compliance in tension, such as a rubber belt, or it may have little compliance in tension, such as a chain. At or near one end, flexible element 150 is coupled support members 198 and 199 at coupling location 194. Coupling location 194 is also the location at which support member 198 is coupled to support member 199. However, flexible element 150 may couple to either support member 198 or support member 199 at alternate locations such as 194*a* or 194*b*. At or near its other end, flexible element 150 couples to the crank system at coupling location 117. Between its ends, flexible element 150 engages guide element 152 and guide element 144 located on arcuate motion member 130. Guide elements 152 and 144 as shown in FIG. 6A are pulleys, but they may be any other component that can guide and support a flexible element such as a cog belt pulley, a sprocket, a roller, or a slide block.

In this example, arcuate motion member 130 is oriented in a generally vertical position. In the context of this specification, an element is oriented in a "generally vertical" position if the element, as measured with respect to its connection points to other elements of the system considered within the range of motion for the element, tends to be closer to vertical than horizontal. It is not necessary that arcuate motion member 130 be straight, nor is it necessary that any portion be exactly vertical. Further, it is not necessary that the member be closer to vertical than horizontal at every moment during its use.

In this example, foot support member 134 may be oriented in a generally horizontal position. In the context of this specification, an element is oriented in a "generally horizontal" position if the element, as measured with respect to its connection points to other elements of the system considered within the range of motion for the element, tends to be closer to horizontal than vertical. It is not necessary that foot support member 134 be straight, nor is it necessary that any portion be exactly horizontal. Further, it is not necessary that the member be closer to horizontal than vertical at every moment during its use.

During operation, the user ascends the exercise device, stands on foot plates 136, and initiates an exercising motion by placing his/her weight on one of foot plates 136. As the user steps downward, force is transmitted through flexible support element 150 causing rotation of crank shaft 114 and brake/inertia device 119. As crank shaft 114 continues to rotate, the effective length of the portion of the flexible element 150 as measured between guide element 144 and coupling location 194 continuously shortens and lengthens. As the above described effective length shortens, coupling location 194 moves closer to guide element 144 causing support members 198 and 199 to alter their relative geometry and thereby lift foot support member 134 and foot plate 136. As crank rotation continues, the user may undertake a striding motion by applying a forward and/or rearward force to foot plates 136. This striding motion results in displacement of foot plates 136 and foot members 134. The combination of displacement of the foot plates 136 by the user and the continuous lifting and lowering of the foot plates through coupling to the crank system may result in a substantially closed path.

The length of the path is instantaneously controlled by the user according to the amount of forward or rearward force applied to foot plates 136. If the user applies little rearward or forward force, the exercise path may be nearly vertical in orientation with little or no horizontal amplitude. Alternately, if the user applies significant rearward or forward force, the exercise path may have significant horizontal amplitude. Alternating weight transfer during exercise from one foot plate to the opposing foot plate transmits force to the crank 112 which sustains rotation of crank 112, crank shaft 114, and brake/inertia device 119. Handles 132 may move in an arcuate pattern and may be grasped by the user.

If the user were to stand stationary on foot plates 136 for an extended period of time, a simple unweighted crank system might settle into a locked "top dead center" position. However, a crank system offset assembly prevents a top dead center lock up. In FIG. 6A, the crank system offset assembly embodiment of FIG. 6 is implemented, but other embodiments of crank system offset assemblies may be used in the FIG. 6A embodiment.

The right and left side pivotal linkage assemblies may be cross coupled through the left and right arcuate motion members so that the right and left foot plates 136 move in opposition. Elements 180 are coupled to arcuate motion members 130. Thus, each of right and left elements 180 move in unison with each right and left arcuate motion member 130, respectively. Connectors 182 couple right and left elements 180 to the right and left sides of rocker arm 184. As arcuate motion members 130 move, connectors 182 cause a rocking motion of rocker arm 184. This rocking motion causes right and left arcuate motion members 130 to move in opposition thus cross coupling the right and left pivotal linkage assemblies.

Additional braking systems may be included in the exercise device to resist horizontal movement of the foot plates. Brake 191 is coupled to the frame 101 and the rocker arm 184. Brake 191 may be of several types such as frictional, electromagnetic, or fluidic. Rather than direct coupling of brake 191 to rocker arm 184, brake 191 could be indirectly coupled to rocker arm 184 through a belt and pulley system. Brake 191 resists rocking motion of rocker arm 184 which in turn resists fore and aft motion of foot support member 134.

Figure 7:
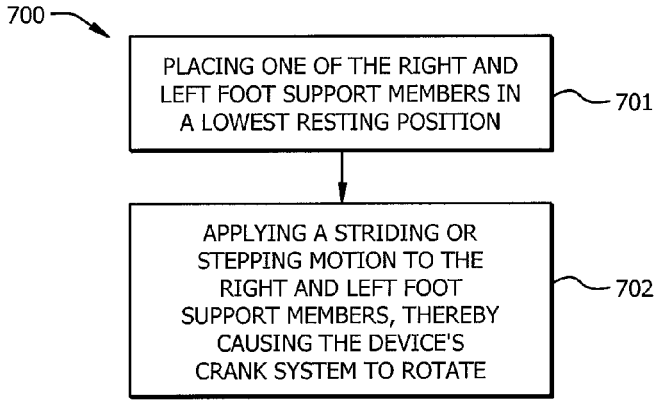
FIG. 7 is an illustration of an example method adapted according to one embodiment of the invention.

FIG. 7 is an illustration of exemplary method 700 adapted according to one embodiment of the invention. Method 700 is a method of use for any of a variety of flexible element exercise devices, some of which are illustrated in FIGS. 2-6A. In some embodiments, method 700 is performed by a user of an exercise device when a user ascends the device, descends from the device, or pauses during exercise.

In step 701, one of the foot support members (either the left or right) is placed in a lowest resting position. Typically, when the first foot support member is in its lowest resting position, the second foot support member is in or near its highest resting position. The lowest resting position is often reached when a user applies more downward force to a first foot support member than to a second foot support member and then pauses the exercise effort.

In some embodiments, e.g., that of FIGS. 2 and 2A, a crank offset system applies an offsetting torque to the crank system and prevents the system from settling into a dead center condition. As a user increases downward force on the second foot support member, the offsetting torque moves the crank system out of the dead center position and the first and second tension vectors do not intersect the axis of rotation of the crank system.

In other embodiments, e.g., that of FIGS. 3-6A, the lowest resting position of the foot support member results in a configuration wherein one of the first and second tension vectors does not intersect the axis of rotation of the crank system. Since at least one tension vector does not intersect the axis of rotation, there is offsetting torque, thereby ensuring that the crank system can rotate.

In step 702, a stepping or striding motion is applied to the right and left foot support members, thereby causing the crank system to rotate.

While method 700 is shown as a series of discrete steps, various embodiments may add, delete, modify, or rearrange various steps. For example, in one embodiment, a user exercises on a flexible element device and then pauses. During the pause, the user lets one of the foot support members reach its lowest resting position. The user then begins striding once the pause in exercise is over. Thus, the user performs step 702, then step 701, followed by step 702. Moreover, the terms "lowest resting position" and "highest resting position" are used for convenience and, in some embodiments, may not literally refer to lowest or highest vertical geometric position of a foot support member only.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, and means described in the specification. As one of ordinary skill in the art will readily appreciate from the disclosure of the present invention, processes, machines, manufacture, compositions of matter, and means presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means.

What is claimed is:

1. An exercise apparatus allowing instantaneously variable striding motions, the exercise apparatus comprising:

a frame;

a crank system supported by the frame and adapted for continuous rotation, said crank system comprising a crank offset assembly configured to apply offset torque to the crank system when the crank system is in a dead center position;

a right foot support member coupled to the frame;

a left foot support member coupled to the frame;

a first flexible support system comprising:

a first flexible element, the first flexible element coupled to the right foot support member and the crank system and operative to rotate the crank system when the right foot support member moves downward; and a second flexible support system comprising:

a second flexible element, the second flexible element coupled to the left foot support member and the crank system and operative to rotate the crank system when the left foot support member moves downward, wherein force may be applied by a user to the right and left foot support members permitting the user to vary among a climbing motion and a closed path walking, striding, or jogging motion, the length of the walking, striding, or motion being instantaneously variable by the user as the user varies between a forward and rearward force applied to the foot support members.

2. The exercise apparatus of claim 1 wherein the crank offset assembly comprises first and second guide elements engaging first and second flexible elements respectively, the first guide element positioned asymmetrically relative to the second guide element.

3. The exercise apparatus of claim 2 wherein the first and second guide elements are positioned asymmetrically with respect to a vertical plane therebetween that is equidistant from both the first and second guide elements.

4. The exercise apparatus of claim 1 wherein the crank offset assembly comprises first and second guide elements engaging first and second flexible elements respectively, at least one guide element having adjustable positioning such that it can be positioned asymmetrically relative to the opposing guide element.

5. The exercise apparatus of claim 4 wherein adjustable positioning is controlled by a servo system.

6. The exercise apparatus of claim 5 wherein the guide element is attached to a rocker mount.

7. The exercise apparatus of claim 6 wherein the position of the rocker mount is controlled by a servo system.

8. The exercise apparatus of claim 1 wherein the crank system comprises a crank shaft and two crank arms.

9. The exercise apparatus of claim 1 wherein the right and left foot members are coupled to the frame through one or more linkage members.

10. The exercise apparatus of claim 1 comprising a brake/inertia system.

11. The exercise apparatus of claim 1 wherein the right and left foot support members are cross coupled by a cross coupling system to provide alternating motion.

12. The exercise apparatus of claim 11 above wherein the cross coupling system is coupled to a brake.

13. The exercise apparatus of claim 1 wherein the first and second flexible elements are selected from the list consisting of:

a belt;

a cog;

a chain; and a cable.

14. The exercise apparatus of claim 1, wherein the first flexible element engages a first plurality of guide elements, each in a different location;

and wherein the second flexible element engages a second plurality of guide elements, each in a different location.

15. An exercise apparatus allowing instantaneously variable striding motions, the exercise apparatus comprising:

a frame;

a crank system with an axis of rotation and adapted for continuous rotation, the crank system comprising first and second crank system coupling locations, the crank system supported by the frame;

a right foot support member comprising a right foot plate, the right foot support member coupled to the frame;

a left foot support member comprising a left foot plate, the left foot support member coupled to the frame;

a first flexible support system comprising a first flexible element operating in tension, the first flexible element coupled to the right foot support member and the first crank system coupling location, wherein a first tension vector defines a first direction of tension in the first flexible element near the first crank system coupling location;

a second flexible support system comprising a second flexible element operating in tension, the second flexible element coupled to the left foot support member and the second crank system coupling location, wherein a second tension vector defines a second direction of tension in the second flexible element near the second crank system coupling location; and a crank offset assembly configured so that at least one of the tension vectors does not intersect the axis of rotation of the crank system when one of the right and left foot plates is at a lowest resting position, wherein a user may apply a force to the foot support members so as to undertake a walking, striding, jogging, or climbing motion and may instantaneously alter the length of the walking, striding, or jogging motion by altering the forward and rearward force applied to the foot support members.

16. The exercise apparatus of claim 15 wherein the crank offset assembly comprises first and second guide elements engaging the first and second flexible elements respectively, the first guide element positioned asymmetrically relative to the second guide element.

17. The exercise apparatus of claim 16 wherein the first and second guide elements are positioned asymmetrically with respect to a vertical plane therebetween that is equidistant from both the first and second guide elements.

18. The exercise apparatus of claim 16 wherein an asymmetrical positioning of the first and second guide elements comprises:

a placement wherein the first and second guide elements have different vertical placements.

19. The exercise apparatus of claim 16 wherein an asymmetrical positioning of the first and second guide elements comprises:

a placement wherein one of the first and second guide elements is closer to a front end of the exercise apparatus than is the other.

20. The exercise apparatus of claim 15 wherein the crank offset assembly comprises:

first and second guide elements engaging the first and second flexible elements respectively, at least one of the guide elements having adjustable positioning such that the at least one guide element can be positioned asymmetrically relative to the opposing guide element.

21. The exercise apparatus of claim 20 wherein the adjustable positioning is controlled by a servo system.

22. The exercise apparatus of claim 20 wherein the at least one guide element is coupled to a rocker mount.

23. The exercise apparatus of claim 22 wherein a position of the rocker mount is controlled by a servo system.

24. The exercise apparatus of claim 15 wherein the crank system comprises a crank shaft and two crank arms.

25. The exercise apparatus of claim 15 wherein the foot member is coupled to the frame by one or more linkage members.

26. The exercise apparatus of claim 15 further comprising an item selected from the list consisting of:

a brake system; and an inertia system.

27. The exercise apparatus of claim 15 wherein the right and left foot support members are cross coupled by a cross coupling system to provide alternating motion.

28. The exercise apparatus of claim 27 wherein the cross coupling system is coupled to a brake.

29. The exercise apparatus of claim 15 wherein the first and second flexible elements are selected from the list consisting of:

a belt;

a cog;

a chain; and a cable.

30. The exercise apparatus of claim 15 wherein the first flexible element engages a plurality of guide elements, each in a different location;

and wherein the second flexible element engages another plurality of guide elements, each in a different location.

31. A method for operating an exercise apparatus, the exercise apparatus including a right foot support member coupled to a first flexible element operating in tension, said first flexible element coupled to a crank system at a first coupling location adapted for continuous rotation, wherein a first tension vector defines a direction of tension in the first flexible element near the first coupling location, and a left foot support member coupled to a second flexible element operating in tension, said second flexible element coupled to the crank system at a second coupling location, wherein a second tension vector defines a direction of tension in the second flexible element near the second coupling location, the method comprising:

placing one of the right and left foot support members in a lowest resting position, wherein one of the first and second tension vectors does not intersect an axis of rotation of the crank system when the lowest resting position is reached.

32. The method of claim 31 wherein one of the first and second tension vectors does intersect the axis of rotation of the crank system when the lowest resting position is reached.

33. The method of claim 31 further comprising:

applying a stepping or striding motion to the right and left foot support members, thereby causing the crank system to rotate.

34. A method for operating an exercise apparatus, the exercise apparatus including a right foot support member coupled to a first flexible element operating in tension, said first flexible element coupled to a crank system at a first coupling location, wherein a first tension vector defines a direction of tension in the first flexible element near the first coupling location, and a left foot support member coupled to a second flexible element operating in tension, said second flexible element coupled to the crank system at a second coupling location, wherein a second tension vector defines a direction of tension in the second flexible element near the second coupling location, the method comprising:

placing one of the right and left foot support members in a lowest resting position, wherein a crank offset mechanism coupled to said crank system applies offset torque to the crank system when the lowest resting position is reached.

35. The method of claim 34 further comprising:

applying a stepping or striding motion to the right and left foot support members, thereby causing the crank system to rotate.

36. An exercise apparatus allowing instantaneously variable striding motions, the exercise apparatus comprising:

a frame;

a crank system supported by the frame;

a right foot support member coupled to the frame;

a left foot support member coupled to the frame;

a first flexible support system comprising:

a first flexible element, the first flexible element coupled to the right foot support member and the crank system and operative to rotate the crank system when the right foot support member moves downward;

a second flexible support system comprising:

a second flexible element, the second flexible element coupled to the left foot support member and the crank system and operative to rotate the crank system when the left foot support member moves downward; and a first guide element engaging the first flexible element and a second guide element engaging the second flexible element wherein at least one of the guide elements has adjustable positioning;

wherein a user may apply a force to the foot support members so as to undertake a walking, striding, jogging, or climbing motion and may instantaneously alter the length of the walking, striding, or jogging motion by altering the forward and rearward force applied to the foot support members.

37. The exercise apparatus of claim 36 wherein adjustable positioning is controlled by a servo system.

38. The exercise apparatus of claim 36 wherein the guide element is attached to a rocker mount.

39. The exercise apparatus of claim 36 wherein the position of the rocker mount is controlled by a servo system.

* * * * *